United States Patent [19]

Thomas

[11] Patent Number: 4,892,193

[45] Date of Patent: Jan. 9, 1990

[54] EXPANDED PLASTIC PACKAGING SYSTEM FOR SUBSTANTIALLY PLANAR OBJECTS

[76] Inventor: Gregg Thomas, 7927 Hesperia Ave., Reseda, Calif. 91335

[21] Appl. No.: 323,191

[22] Filed: Mar. 13, 1989

Related U.S. Application Data

[63] Continuation of Ser. No. 85,527, Aug. 14, 1987, abandoned.

[51] Int. Cl.[4] ..... B65D 85/48

[52] U.S. Cl. ..... 206/453; 206/454; 206/606

[58] Field of Search ..... 206/606, 434, 453

[56] References Cited

U.S. PATENT DOCUMENTS

| | | | |
|---|---|---|---|
| 3,491,914 | 1/1970 | Elzey | 220/60 |
| 3,589,507 | 6/1971 | Greenberg | 206/454 |
| 3,615,006 | 10/1971 | Freed | 206/454 |
| 3,687,352 | 8/1972 | Kalajian | 206/606 |
| 3,750,871 | 8/1973 | Cook | 206/46 |
| 3,813,025 | 5/1974 | Solomon | 229/2.5 |
| 3,939,978 | 2/1976 | Thomaswick | 206/454 |
| 4,287,990 | 9/1981 | Kurick | 206/454 |
| 4,386,702 | 6/1983 | Schultz et al. | 206/523 |
| 4,542,822 | 9/1985 | Kennedy, Jr. et al. | 206/45.33 |

OTHER PUBLICATIONS

Defensive Publication Ser. No. 801,566, 5-27-1969, Rissberger, Jr. et al.

*Primary Examiner*—Joseph Man-Fu Moy
*Attorney, Agent, or Firm*—Sheldon & Mak; R. Dabney Eastham

[57] ABSTRACT

A packaging system for substantially planar objects such as paintings and prints is disclosed which has two major components made of expanded plastic such as polystyrene foam. The two major components may be a bottom with a lid, two bottoms or two lids. The two major components are sealed around the object with flexible adhesive tape. The outside of the container so formed may be covered with a plastic coating to protect the expanded plastic from damage and soiling and the two major components may be joined by a hinge. Impact strips of plastic foam are provided to protect the artwork from impact forces and plastic foam cushions and expanded plastic spacers are used to securely fasten and protect the artwork.

34 Claims, 2 Drawing Sheets

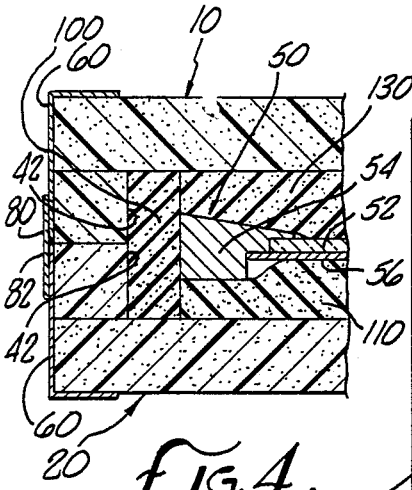
FIG. 4.
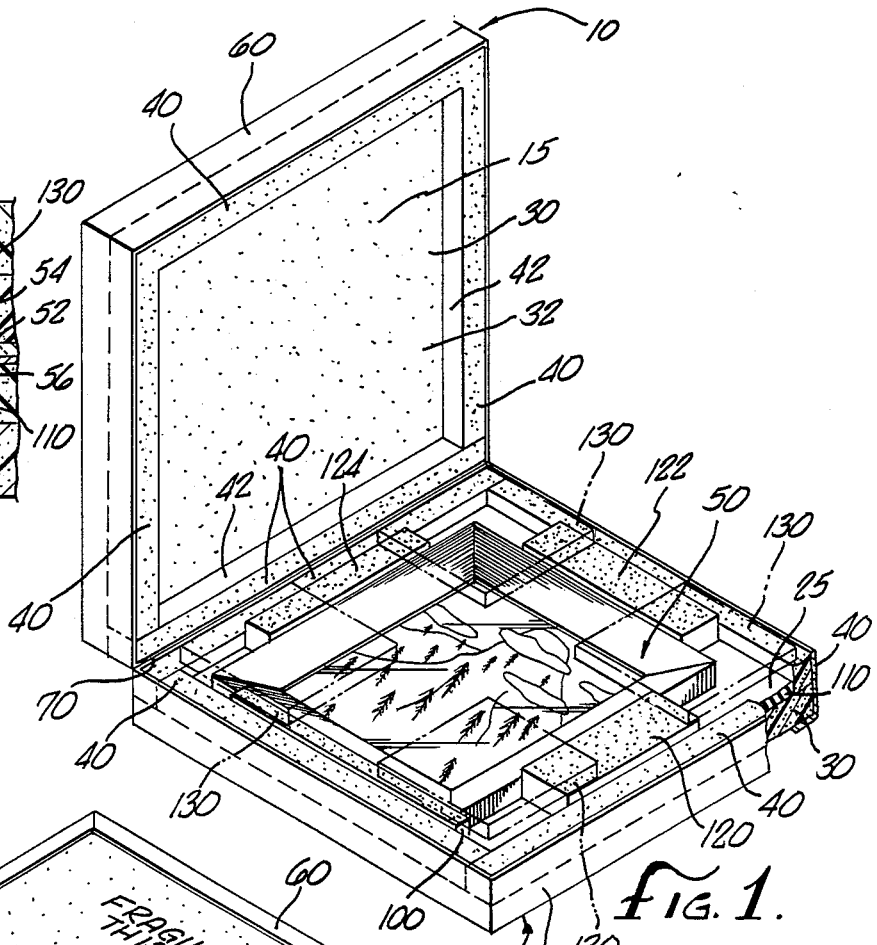
FIG. 1.
FIG. 2.
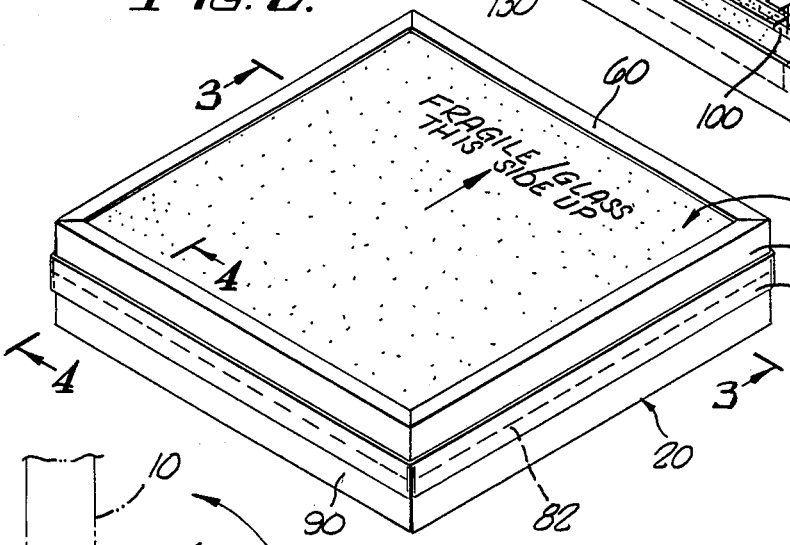
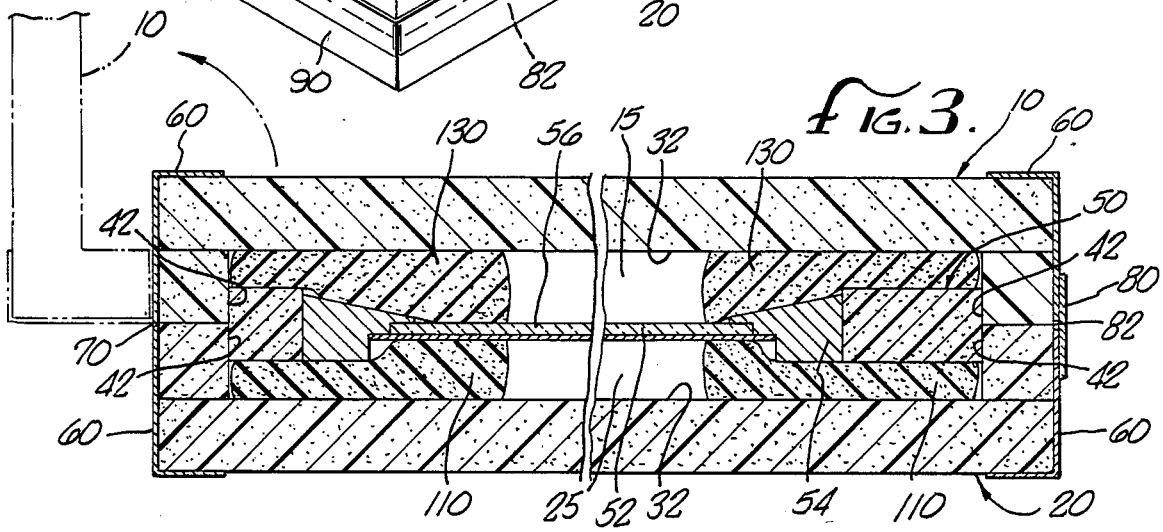
FIG. 3.

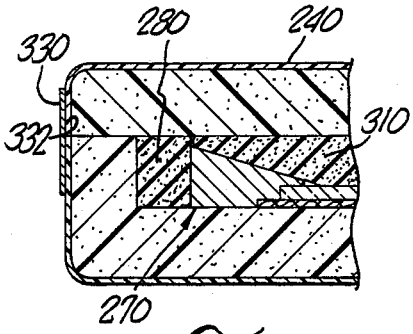
FIG. 8.
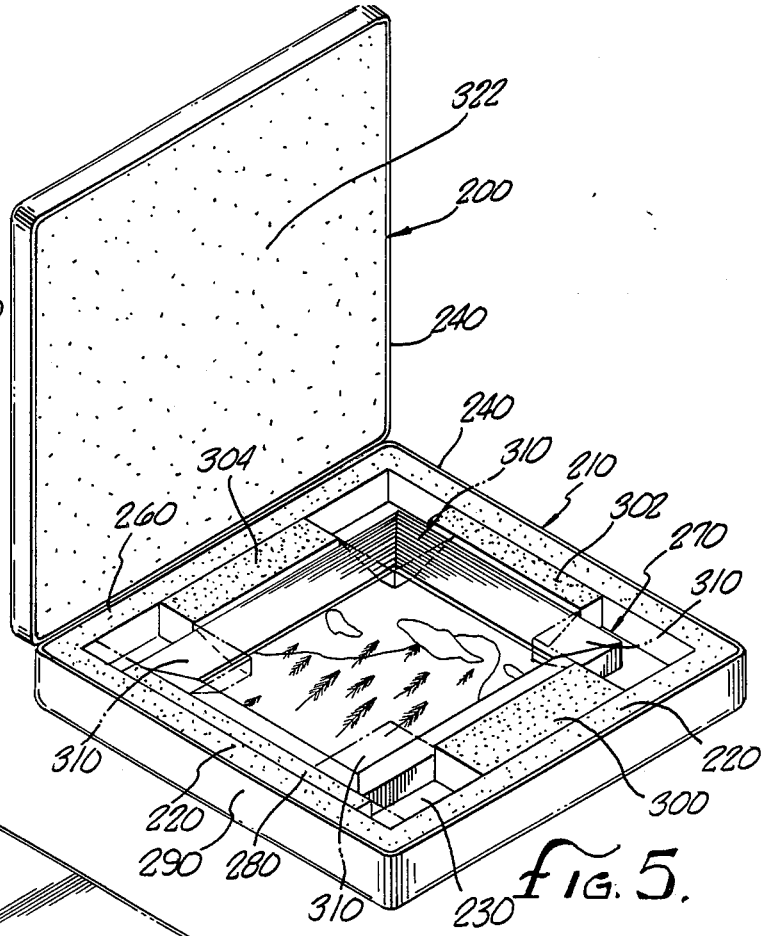
FIG. 5.
FIG. 6.
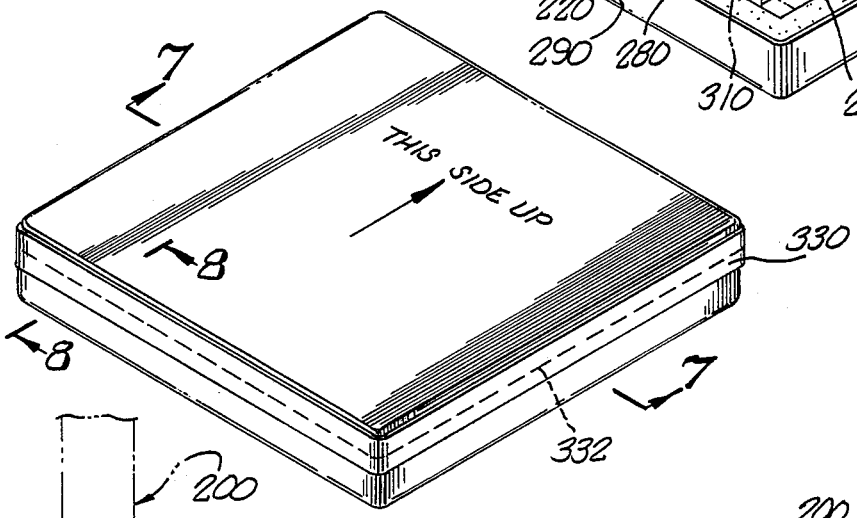
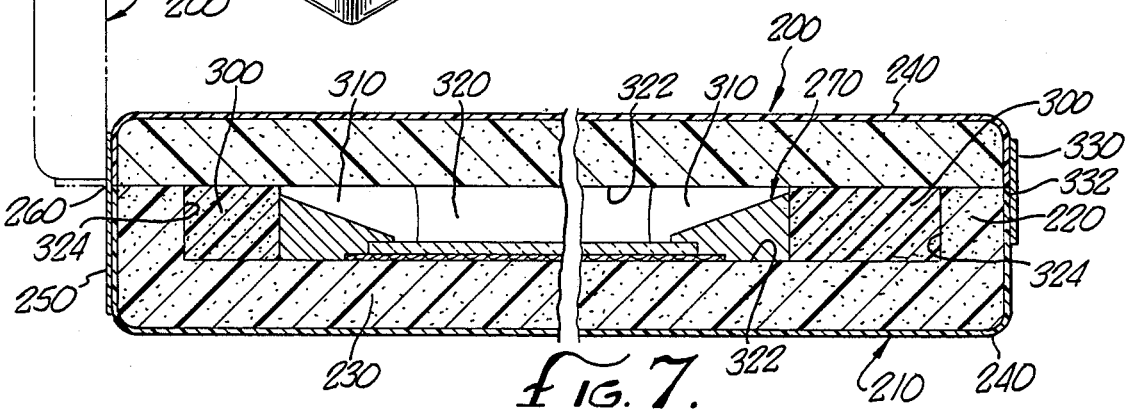
FIG. 7.

EXPANDED PLASTIC PACKAGING SYSTEM FOR SUBSTANTIALLY PLANAR OBJECTS

"This is a continuation of co-pending application Ser. No. 0/085,527 filed on Aug. 14, 1987."

BACKGROUND OF THE INVENTION

The field of the invention is that of packaging for containing and shipping objects and, in particular, substantially planar objects requiring more protection than traditional packing materials, especially conventional corrugated cartons.

Framed artwork such as paintings and prints are typically substantially planar (but three-dimensional) objects. In form, they resemble the ideal solids known as right rectangular parallelepipeds (one dimension being considerably less than the other two). Other shapes are known, however, such as cylinders (of wide radius and low height) and prisms (having polygon bases such as triangles and a low height). This range of solids, which are thinner in one dimension compared to the other two, will be referred to hereafter as "substantially planar objects," and may include any object having these forms and not just artwork. Mirrors, for example, would be included in the category "substantially planar objects." For convenience, the discussion of the art and the preferred embodiments will focus on artwork although the invention is to be understood as not being limited to packaging for artwork.

When artwork is shipped, as from a gallery to a customer's home, from one gallery to another or museum to museum, it should be packaged in order to protect it from harm. Such harm may result from impact forces due to droppage and ripping and tearing forces due to handling and stacking. Damage from water or other fluids must be prevented. The artwork must be protected from dirt, dust, vibration, and scratching. Artwork with glass needs special protection from breakage. Therefore, packaging must be provided to protect the artwork from these dangers.

A number of packaging systems are currently used for shipping artwork, including the common corrugated cardboard carton. When using cartons, the artwork must be protected from external forces by wrapping the artwork with some type of protective covering, usually bubblewrap (plastic sheeting formed with air bubbles trapped between the sheets). This system is limited by the size and shape of the available cardboard carton, i.e., the carton cannot adapt or conform to the art being shipped. It either fits or it does not and a wide variety of cartons are not economically and readily available for artwork. Moreover, this method offers only marginal protection against vibration and shock encountered when the package is dropped or mishandled.

Consequently, most artwork, especially valuable artwork, is crated for shipment. A wooden crate is literally built around the bubblewrapped piece(s). Packaging of this sort is costly, heavy, and suffers from the disadvantage of having to be tailor-made for each piece of artwork. Nevertheless, the art industry has tolerated the high cost and other difficulties associated with this packaging system in order to provide the level of protection necessary for expensive artwork. No system is currently available which can easily and cheaply accommodate the virtual infinite variety of sizes and thicknesses of commercially available artwork.

Expanded plastic is durable, waterproof, light, shock absorbent, and inexpensive. In more rigid densities and when reinforced, it is also reusable. Expanded plastic in softer densities has been used to protect other objects such as cameras, lenses, video equipment, etc. and occasionally molded poly styrene "corners" are placed over the corners of artwork for protection. But these uses invariably employ a separate external shipping container. The external shipping container is most often a corrugated carton. Occasionally, as disclosed in U.S. Pat. No. 3,750,871, polystyrene may be used in conjunction with another, more rigid material (in this case, fiberboard). It is the fiberboard which provides the basic structural integrity of the container. The polystyrene is used as end caps for the shipping tube. Other examples of containers employing expanded plastic are U.S. Pat. No. 3,491,914, U.S. Pat. No. 4,386,702, and U.S. Pat. No. 4,542,822.

These examples of the use of expanded plastic for packaging systems have drawbacks when applied to substantially planar objects such as artwork. For example, artwork comes in various sizes and a packaging system should be capable of accommodating artwork within a range of sizes in order to be useful to the customer. Therefore, expanded plastic packaging systems which are shaped to fit an object of specific size and shape would be of limited value.

A packaging system for artwork should also be waterproof, and it should provide for absorption of impact forces in order to protect the delicate artwork contained in the packaging. The packaging system should be durable in order to be capable of reuse and, furthermore, should be easy to use. Packaging and unpackaging the artwork should be quick, easy, and should not require the use of too many tools, and should be simple and not require any special training. The ideal packaging system should be inexpensive, lightweight, strong, and reusable, if possible. It must be able to adjust or adapt to the virtual infinite range of commercially available sizes and thicknesses of wall artwork and be economically produceable for custom needs such as lamps, vases, crystal and the like.

SUMMARY OF THE INVENTION

An object of this invention, therefore, is to provide an improved packaging system for substantially planar objects, such as artwork, especially objects whose fragility require more protection than is afforded by common corrugated cardboard cartons. A further object of the present invention is to provide a packaging system capable of meeting the requirements described above in the background of the invention. Other objects and features of the invention will become apparent to those skilled in the art in light of the description and drawings of the preferred embodiments of the packaging system of the invention.

The invention is a packaging system for substantially planar objects. It comprises a container made from expanded plastic and having two parts: either two bottoms, a bottom and a lid, or a lid and a lid. The two bottoms, the bottom and the lid, or the lid and the lid are placed around the substantially planar object to be packaged and the two are joined together by sealing a strip of adhesive tape along and over their outside juncture. At least one impact strip of plastic foam may be provided to protect the substantially planar object contained within a cavity of the container from damage by impact forces.

The expanded plastic of the container may be protected from injury and dirt by covering at least a portion of the exterior surface of the container with a plastic coating or tape covering which provides a protective shell. For my invention, the density of the expanded polystyrene is chosen to offer a desirable balance between shock absorbency and rigidity for structural strength. With the edges and corners reinforced against chipping and cracking with plastic sealing tape, the need for an exterior structural component such as a crate or cardboard box has been eliminated.

The two parts of the container may be hinged together by adhesive tape at a juncture of the two pieces or by adhering a flexible strip of plastic tape to the chosen juncture between the two pieces. Spacers of expanded plastic and cushions of plastic foam may be provided to securely contain the substantially planar object within the packaging. The spacers provided with the system are intended primarily to easily, quickly, and cheaply adapt the box to artwork that is somewhat smaller than the box cavity. The foam cushions are intended primarily to protect the art.

The containers of the packaging system according to the invention may be made available in a variety of standard sizes, but each size can accommodate a wide range of artwork through the use of expanded spacers provided with each box. In a preferred embodiment the spacers are typically 24 inches by 1½ inches and are provided in ½ inch increments from ½ inch up to 3 inches. So, for example, a box measuring 40 inches by 40 inches may conveniently be made to adapt to artwork measuring 39 inches by 36 inches, 38 inches by 37 inches, 37 inches by 34 inches, etc., by quickly inserting the provided spacers and thus assuring a secure fitting. At least one impact strip of plastic foam may be placed between the artwork and the designated bottom of the box.

BRIEF DESCRIPTION OF THE DRAWINGS

FIG. 1 is a perspective view of a preferred embodiment of the packaging system according to the invention, with a partial cut-away;

FIG. 2 is another perspective view of a preferred embodiment of the packaging system according to the invention;

FIG. 3 is a cross-section taken along section line 3—3 in FIG. 2;

FIG. 4 is a partial cross-section taken along section line 4—4 in FIG. 2;

FIG. 5 is a perspective view of a second preferred embodiment of the packaging system according to the invention;

FIG. 6 is another perspective view of the second preferred embodiment of the packaging system according to the invention;

FIG. 7 is a cross-section taken along section line 7—7 in FIG. 6; and

FIG. 8 is a partial cross-section taken along section line 8—8 in FIG. 6.

DETAILED DESCRIPTION OF THE PREFERRED EMBODIMENT

The packaging system according to the invention is a flexible system capable of packaging substantially planar objects of varying width, height, length, and fragility. Two preferred embodiments are shown in the drawings and described herein. The first, corresponding to FIGS. 1–4, is a first preferred embodiment in use with an artwork containing glass and requiring special protection; the second, corresponding to FIGS. 5–8, is a second preferred embodiment in use with an artwork lacking glass (perhaps using plexiglas) and requiring less protection.

The preferred embodiments of the packaginq system use major structural components made of expanded plastic: bottoms and lids. FIG. 1 depicts the first preferred embodiment, which has bottoms 10 and 20. Bottoms 10 and 20 are constructed of base sheets 30 and walls 40 and are identical in size. Base sheets 30 are rectangular but may be dimensioned as any polygon (although rectangles are most useful overall). Walls 40 are glued onto the edges of base sheets 30 and are also glued where the walls 40 meet each other. Instead of gluing the pieces together, a bottom may be molded into a single piece using an injection mold or similar system, as in the second preferred embodiment of FIGS. 5–8. The partial cutaway in FIG. 1, the cross-section of FIG. 3, and the partial cross-section of FIG. 4 show attachment of the walls 40 to base sheets 30. Each base sheet 30 and its four glued-on walls 40 forms a bottom which is a shallow, water-proof, open-mouthed box. Base sheets 30 and the glued-on walls 40 define, for each bottom, cavities 15 and 25 having a polygonal (in this case a rectangle) inside surface 32 and sides 42. Cavities 15 and 23 are best seen in FIG. 3.

Base sheets 30 and walls 40 are cut from two pound expanded polystyrene sheeting. This material is firm, durable, inexpensive, waterproof, and absorbs shock. Expanded polystyrene is preferred for the material of base sheets 30 and walls 40 but other expanded plastics with similar characteristics may be used. Examples are expanded polyvinyl, expanded polypropylene, and expanded polyethylene.

The outside edges of bottoms 10 and 20 are covered with adhesive plastic tape 60 similar to box sealing tape although other types may be used. Tape 60 protects the edges and corners from chipping or cracking during rough handling and materially enhances its qualities as an external shipping container. All outside surfaces of the bottoms 10 and 20 may be covered by tape 60 for durability and resistance to dirt, but at a minimum I have found that covering the edges as shown in FIG. 1–4 will suffice, since these are the parts of the packaging which will be grasped during movement, on which the packaging will rest during storage and travel, and on which the packaging is most likely to fall. It is also an ideal surface on which to write shipping and handling information. Uncoated polystyrene is somewhat porous and difficult to write on. Alternatively, instead of taping, the edges and corners may be dipped in or sprayed with a coating that will provide the same tough protection as the tape.

Tape 60 also is used to join bottoms 10 and 20 along hinge line 70, which may be seen in FIGS. 1 and 3. Hinge line 70 is the only place tape 60 connects bottoms 10 and 20. Tape 60 at hinge line 70 permits bottoms 10 and 20 to separate and close like a book (best seen in FIG. 3, with the open position indicated in phantom). I have found this arrangement to be very useful because it keeps the two bottoms together (prevents one from becoming lost) and keeps the two bottoms aligned together when they are closed together, for easier sealing with adhesive tape 80 (shown in FIGS. 2, 3, and 4).

Artwork 50 is shown as a typical painting with a protective glass panel 52 over the painting (see FIG. 3). Some other components of artwork 50 are frame 54, and cardboard backing 56. These components of artwork 50 are best seen in the cross-sections of FIGS. 3 and 4. The glass panel 52 is fragile and requires special protective measures which my packaging system provides.

Artwork 50 requires protection from impact forces due to the packaging being dropped on its bottom edge. The "bottom edge" of the packaging is that edge of the completed packaging (see FIG. 2) which is arbitrarily chosen to be the bottom edge 90. The completed packaging will normally be stored on this bottom edge 90, and will be carried about with this bottom edge 90 down. The edge with hinge line 70 should preferably not be chosen as bottom edge 90 because the bottom edge 90 receives wear which could damage tape 60 forming the hinge between bottoms 10 and 20.

Protection from impact forces transmitted from bottom edge 90 is provided by plastic foam impact strip 100, which may be seen in FIGS. 1 and 4. Plastic foam impact strip 100 is preferably made from 1.2 grey foam although any plastic foam that is substantially more elastic and compressible (thus more impact absorbent) than the expanded plastic of bottoms 10 and 20 will serve. Impact strip 100 is placed in the cavities 15 and 25 of bottoms 10 and 20 against those particular walls 40 which also form part of bottom edge 90 of the packaging. Impact strip 100 is positioned between artwork 50 and sides 42 of the walls 40 that are adjacent bottom edge 90. This permits the impact strip to absorb impact forces from bottom edge 90 before these forces reach artwork 50.

Square plastic foam cushions 110, which may be seen in FIGS. 1, 3, and 4, are placed in the cavity 25 of bottom 20 under the corners of artwork 50. These pads may be made of the same plastic foam as impact strip 100, and protect and support artwork 50.

Spacers 120, 122, and 124, which may be seen in FIGS. 1 and 4, may be made of expanded polystyrene strips and are placed between artwork 50 and walls 40 of bottoms 10 and 20. These spacers hold artwork 50 firmly in place and prevent it from shifting laterally (to and from walls 40).

Four square plastic foam cushions 130, which may be seen in FIGS. 1, 3, and 4, are placed over the corners of artwork 50 and will fit into cavity 15 of bottom 10. Foam cushions 130 may be made of the same plastic foam as impact strip 100. These cushions also serve to protect and support artwork 50.

Once impact strip 100, cushions 110 and 130, and spacers 120 are in place next to artwork 50, bottom 10 can be closed against bottom 20 by rotating bottom 10 about hinge line 70. Once bottom 10 is shut against bottom 20, as in FIG. 3, the two bottoms are taped together by running adhesive tape 80 over their outside juncture 82. Taping the two bottoms together is a very simple and quick operation that does not require special tools. Hinge line 70 need not be taped. Tape 80 provides a strong, waterproof seal of the contents in the packaging.

When the packaging of the first embodiment of the invention is sealed, the plastic foam cushions 110 and 130 deform around artwork 50, as is best seen in FIGS. 3 and 4. Artwork 50 is securely and protectively held by the combination of strip 100, cushions 110 and 130, and spacers 120.

The first preferred embodiment shown in FIGS. 1–4 and described above uses two bottoms, 10 and 20, to provide a sufficiently large cavity within the packaging to contain the combined thickness of artwork 50 and cushions 110 and 130. Alternatively, the walls 40 of a first bottom could be made higher so as to increase the height of the cavity encompassed by the walls and base sheet of that bottom so that a lid could be substituted for the second bottom. The lid could be composed of a rectangular sheet of expanded polystyrene. Such a lid would be hinged to and attached to the bottom in the same way as the two bottoms are shown to be in the first preferred embodiment of FIGS. 1–4. The packaging system of the invention, however, can provide standard-sized bottoms and lids so that various combinations of bottoms and lids can be provided in order to package artwork of varying thicknesses together with various combinations of cushions.

The second preferred embodiment of the invention is shown in FIGS. 5–8 and contains some features of the invention not shown in the first preferred embodiment. Referring now to FIG. 5, a lid 200 of expanded polystyrene sheet is provided together with a molded bottom 210 of expanded polystyrene. Bottom 210 has integrally formed therein walls 220 and a base sheet 230. By contrast, in the first preferred embodiment depicted in FIGS. 1–4 the bottoms were constructed by gluing walls 40 to base sheets 30.

Both lid 200 and bottom 210 are provided with a durable plastic coating or shell 240 for their exteriors. The shell 240 may be applied to the expanded polystyrene of lid 200 and bottom 210 by painting, spraying or otherwise applying the plastic in a liquid form and allowing the same to harden on the expanded polystyrene. The plastic shell 240 should be durable and firm enough to protect the expanded polystyrene but not so brittle as to crack under impact. It may be made of polyacrylic, polyvinyl chloride (PVC) or the like. Its purpose is to protect the expanded polystyrene from cracking and chipping. It also provides an easy-to-clean exterior surface for the packaging. It takes the place of the adhesive tape 60 used in the first embodiment depicted in FIGS. 1–4 although adhesive tape could be used for the second preferred embodiment just as for the first, and the plastic coating could be used for the first preferred embodiment just as for the second.

Lid 200 is hinged to bottom 210, as in the first embodiment shown in FIGS. 1–4. In the case of the second preferred embodiment of FIGS. 5–8, however, the hinge is provided by a strip 250 of flexible plastic, which may be polyvinyl, and is glued onto one of the exterior edges of lid 200 and of bottom 210 to form hinge line 260. Plastic strip 250 is best seen in FIGS. 7 and 8. FIG. 7 also shows how lid 200 can open like a book away from bottom 210. The open position of the lid is depicted in phantom.

Artwork 270 shown in FIG. 5 is another painting. Artwork 270, however, does not have a glass panel (it may have a plexiglass panel) and is less fragile than artwork 50 depicted in FIG. 1. Accordingly, artwork 270 may be placed directly onto the base sheet 230 of bottom 210 without the need for plastic foam cushions. An impact strip 280 of plastic foam is provided between artwork 270 and that wall 220 which is next to the arbitrarily chosen bottom edge 290 of the packaging. Impact strip 280 protects artwork 270 from impact forces delivered from the wall 220 adjacent bottom edge 290.

Spacers 300, 302, and 304 are inserted between artwork 270 and various walls 220, as needed, in order to secure the artwork in place. The spacers are made of expanded polystyrene. Square plastic foam cushions 310, shown in phantom in FIG. 1, are placed over the corners of artwork 270 to help secure and protect the artwork. When the artwork 270, spacers 300, 302, and 304, cushions 310, and the impact strip 280 are in place, lid 200 is folded over and against bottom 210 so that artwork 270 and the various spacers, cushions and the impact strip are completely secured inside the cavity 320 defined by bottom 210 and lid 200. Cavity 320 has two inside surfaces 322 and four sides 324, best seen in FIG. 7. Bottom 210 and lid 200 are secured to each other and sealed by a strip of adhesive tape 330 placed over outside juncture 332 which provides a waterproof seal for the packaging, as may be seen in FIGS. 6, 7, and 8. As with the preferred embodiment of FIGS. 1–4, adhesive tape 330 is easy to apply and requires no special tools for its application.

Although a bottom and a lid are shown in the second preferred embodiment depicted in FIGS. 5–8, two bottoms 210 could just as easily have been provided if needed to surround a bulky artwork or to provide enough room for foam cushions to secure a fragile artwork, just as was shown in the first preferred embodiment depicted in FIGS. 1–4. Furthermore, two lids having complementary polygonal outlines could be hinged and joined together by adhesive tape to package a substantially flat object, such as an unframed print. This embodiment of the packaging system of the invention is not specifically shown in the drawings but the lid of the second embodiment of FIGS. 5–8 would suffice if paired and joined as the lid and the bottom of the second embodiment are joined. No impact strips or cushions would be needed.

The packaging system according to the invention provides a flexible system of bottoms and lids which is capable of accommodating various kinds of artwork. With the use of various sized spacers, artwork of varying dimensions can be securely and firmly contained inside the packaging system. In fact, the customer will normally be provided with spacers of varying widths which the customer can break up into pieces and use to pack the artwork into the chosen container (bottom and bottom or bottom and lid). Thus, packaging systems of bottoms and lids or bottoms and bottoms may be provided (together with a set of spacers, cushions and impact strips) to the customer in a limited number of standard sizes, each of which is capable of handling a range of different sizes of artwork. Alternatively, the packaging system may be custom-designed to fit the combination of a specific substantially planar object and an impact strip.

Thus, preferred embodiments of the invention have been illustrated and described with reference to the accompanying drawings. Those skilled in the art will understand that these preferred embodiments are given by way of example only. Various changes and modifications may be made without departing from the scope and spirit of the invention, which is intended to be defined by the appended claims.

What is claimed is:

1. In combination, a substantially rigid bottom of expanded plastic and a complementary substantially planar and rigid lid of expanded plastic, the bottom and the lid each having exterior edges and corners and the bottom internally defining an open-faced cavity having sides and a polygonal inside surface, the open-faced cavity being adapted to receive through the open face and contain a substantially planar object, the lid being so dimensioned that it may be placed over the open face of the cavity in the bottom to cover the same and at least one strip of adhesive plastic tape may be placed over and along an outside juncture of the bottom and the lid in order to detachably secure the lid to the bottom and seal the cavity, the bottom and the lid each having a protective plastic coating on the edges and corners to resist chipping and cracking and an impact absorption means adapted to be placed within the cavity and between the object and at least one side of the cavity in order to absorb impact forces transmitted from the side of the cavity to the object.

2. The combination of claim 1 wherein the impact absorption means comprises a strip of plastic foam.

3. The combination of claim 2 in which the plastic foam of the strip is more elastic and compressible than the expanded plastic of the lid and the container.

4. The combination of claim 1 further comprising a plastic coating on at least part of an outer surface of the lid and of the bottom, in addition to the edges and corners of each of the bottom and the lid.

5. The combination of claim 4 in which the plastic coating applied to the outer surface of the lid and the bottom comprises adhesive plastic tape.

6. The combination of claim 4 in which the plastic coating is an adhesive plastic applied in liquid form onto at least part of the outer surface of the lid and of the bottom and allowed to harden, the hardened adhesive plastic coating being harder and more durable than the expanded plastic of the lid and the bottom.

7. The combination of claim 1 further comprising at least one cushion of plastic foam to be placed between the lid and the object in the cavity.

8. The combination of claim 1 further comprising at least one cushion of plastic foam to be placed between the polygonal inside surface of the bottom and the object in the cavity.

9. The combination of claim 1 further comprising a hinge joining the lid and the bottom so that the bottom and the lid may hingeably cooperate together.

10. In combination, first and second substantially rigid bottoms of expanded plastic, the bottoms each having exterior edges and corners and internally defining an open-faced cavity having sides and a polygonal inside surface, the open-faced cavity being adapted to receive through the open face and contain a substantially planar object, the first and second bottoms being so dimensioned that the bottoms may be mated at the open faces of the respective cavities of the first and second bottoms to define a larger cavity having sides formed of the combined sides of the cavities and two polygonal inside surfaces and at least one strip of adhesive plastic tape may be placed over and along an outside juncture of the first and second bottoms in order to detachably secure the first and second bottoms to each other and seal the cavity, the first and second bottoms each having a protective plastic coating on the edges and corners to resist chipping and cracking and impact absorption means adapted to be placed within the larger cavity and between the object and at least one side of the larger cavity in order to absorb impact forces transmitted from the side of the large 11. The combination of claim 10 wherein the impact absorption means comprises a strip of plastic foam.

12. The combination of claim 11 in which the plastic foam of the impact strip is more elastic and compressible than the expanded plastic of the first and second bottoms.

13. The combination of claim 10 further comprising a plastic coating on at least part of an outer surface of each of the first and second bottoms, in addition to the edges and corners of each of the first and second bottoms.

14. The combination of claim 13 in which the plastic coating applied to the outer surface of each bottom comprises adhesive tape.

15. The combination of claim 13 in which the plastic coating is an adhesive plastic applied in liquid form onto at least part of the outer surface of the first and second bottoms and allowed to harden, the hardened adhesive plastic coating being harder and more durable than the expanded plastic of the first and second bottoms.

16. The combination of claim 10 further comprising a plurality of cushions of plastic foam to be placed between the inside polygonal surfaces and the object in the larger cavity.

17. The combination of claim 10 further comprising a hinge joining the first and second bottoms so that the first and second bottoms may hingeably cooperate to join the open mouths of their respective cavities.

18. In combination, first and second substantially rigid and planar lids of expanded plastic having complementary polygonal outlines and exterior edges and corners, and a hinge joining the first and second lids so that the first and second lids may hingeably cooperate to lie flat next to each other when enclosing a substantially flat object, and at least one strip of adhesive plastic tape may be placed over and along an outside juncture of the first and second lids in order to detachably secure the first lid to the second lid and seal the flat object between the first and second lids, the first and second lids each having a protective plastic coating on the edges and corners to resist cracking and chipping.

19. A packaging system for substantially planar objects, comprising:

a substantially rigid bottom, the bottom comprising a rectangular base sheet of expanded plastic and four walls of expanded plastic at the edges of the rectangular base sheet, the walls and the rectangular base sheet defining an open-faced cavity having five sides and an open face for receiving a substantially planar object through the open face and containing the same;

a substantially rigid lid comprising a rectangular sheet of expanded plastic dimensioned to fit over and close the open face of the cavity defined in the bottom;

the walls and base sheet of the bottom defining exterior edges and corners, the lid also having edges and corners, the edges and corners of the bottom and lid having a protective plastic coating to resist chipping and cracking; and at least one impact strip adapted to be placed within the cavity between the object and at least one side of the bottom in order to absorb impact forces transmitted from the side to the object.

20. The packaging system of claim 19 further comprising at least one strip of adhesive tape placed over and along an outside juncture of the lid and the bottom in order to detachably secure the lid to the bottom and seal the cavity.

21. A packaging system for substantially planar objects, comprising:

first and second substantially rigid bottoms, the first and second bottoms each comprising a rectangular base sheet of expanded plastic and four walls of expanded plastic at the edges of the rectangular base sheet, the walls and the rectangular base sheet defining an open-faced cavity having five sides and an open face for receiving a substantially planar object through the open face and containing the same;

the walls and base sheet of each of the bottoms defining exterior edges and corners, the edges and corners having a protective plastic coating to resist chipping and cracking; and at least one impact strip adapted to be placed within the cavity between the object and at least one side of at least one of the bottoms in order to absorb impact forces transmitted from the side to the object.

22. The packaging system of claim 21 further comprising at least one strip of adhesive tape placed over and along an outside juncture of the first and second bottoms in order to detachably secure the first bottom to the second bottom and seal the two cavities of the first and second bottoms.

23. A packaging system for a substantially flat object, comprising:

first and second substantially rigid and planar lids of expanded plastic having complementary rectangular outlines and exterior edges and corners;

a hinge joining the first and second lids so that the first and second lids may hingeably cooperate to lie flat next to each other when enclosing the substantially flat object; and the first and second lids each having a protective plastic coating on the edges and corners to resist cracking and chipping.

24. The packaging system of claim 23 further comprising at least one strip of adhesive tape placed over and along an outside juncture of the first and second lid in order to detachably secure the first lid to the second lid and seal the substantially flat object between the first and second lid.

25. The combination of claim 10 in which the plastic coating comprises adhesive tape.

26. The combination of claim 10 in which the plastic coating is an adhesive plastic applied in liquid form onto edges and corners of the first and second bottoms and allowed to harden, the hardened adhesive plastic coating being harder and more durable than the expanded plastic of the first and second bottoms.

27. The combination of claim 1 in which the plastic coating comprises adhesive tape.

28. The combination of claim 1 in which the plastic coating is an adhesive plastic applied in liquid form onto edges and corners of the bottom and the lid and allowed to harden, the hardened adhesive plastic coating being harder and more durable than the expanded plastic of the bottom and the lid.

29. The combination of claim 18 in which the plastic coating comprises adhesive tape.

30. The combination of claim 18 in which the plastic coating is an adhesive plastic applied in liquid form onto edges and corners of the first and second lids and allowed to harden, the hardened adhesive plastic coating being harder and more durable than the expanded plastic of the first and second lids.

31. The packaging system of claim 19 in which the plastic coating comprises adhesive tape.

32. The packaging system of claim 19 in which the plastic coating is an adhesive plastic applied in liquid form onto edges and corners of the bottom and the lid and allowed to harden, the hardened adhesive plastic coating being harder and more durable than the expanded plastic of the bottom and the lid.

33. The packaging system of claim 23 in which the plastic coating comprises adhesive tape.

34. The packaging system of claim 23 in which the plastic coating is an adhesive plastic applied in liquid form onto edges and corners of the first and second lids and allowed to harden, the hardened adhesive plastic coating being harder and more durable than the expanded plastic of the first and second lids.

* * * * *